US007086844B2

(12) United States Patent
Kimura et al.

(10) Patent No.: US 7,086,844 B2
(45) Date of Patent: Aug. 8, 2006

(54) MULTI-STAGE SCROLL FLUID MACHINE HAVING A SET A SEAL ELEMENTS BETWEEN COMPRESSION SECTIONS

(75) Inventors: Hideyuki Kimura, Yokohama (JP); Atsushi Unami, Yokohama (JP)

(73) Assignee: Anest Iwata Corporation, Tokyo (JP)

( * ) Notice: Subject to any disclaimer, the term of this patent is extended or adjusted under 35 U.S.C. 154(b) by 0 days.

(21) Appl. No.: 11/208,861

(22) Filed: Aug. 23, 2005

(65) Prior Publication Data

US 2005/0287028 A1 Dec. 29, 2005

Related U.S. Application Data

(62) Division of application No. 10/729,908, filed on Dec. 9, 2003, now Pat. No. 7,001,161, which is a division of application No. 10/289,440, filed on Nov. 7, 2002, now Pat. No. 6,682,328, which is a division of application No. 09/983,017, filed on Oct. 22, 2001, now abandoned.

(30) Foreign Application Priority Data

Oct. 20, 2000 (JP) ..... 2000-322025

(51) Int. Cl.
*F04C 18/00* (2006.01)
*F03C 2/00* (2006.01)

(52) U.S. Cl. ..... 418/55.4; 418/6; 418/55.2; 418/142

(58) Field of Classification Search ..... 418/6, 418/55.4, 55.2, 142, 55.1, 55.3, 55.5, 57
See application file for complete search history.

(56) References Cited

U.S. PATENT DOCUMENTS

| | | | | |
|---|---|---|---|---|
| 940,817 | A | 11/1909 | Clark et al. | |
| 3,994,636 | A * | 11/1976 | McCullough et al. | 418/55.4 |
| 4,141,677 | A | 2/1979 | Weaver et al. | |
| 4,157,234 | A | 6/1979 | Weaver et al. | |
| 4,382,754 | A | 5/1983 | Shaffer et al. | |
| 5,258,046 | A | 11/1993 | Haga et al. | |
| 6,659,743 | B1 | 12/2003 | Kimura et al. | |
| 6,709,248 | B1 * | 3/2004 | Fujioka et al. | 418/55.4 |
| 6,736,620 | B1 | 5/2004 | Satoh | |

FOREIGN PATENT DOCUMENTS

| | | | | |
|---|---|---|---|---|
| EP | 283282 | A2 * | 9/1988 | 418/55.4 |
| EP | 468238 | A1 * | 1/1992 | 418/55.4 |
| JP | 54-59608 | | 5/1979 | |
| JP | 63173873 | A * | 7/1988 | 418/55.4 |
| JP | 07091383 | A | 4/1995 | |

* cited by examiner

*Primary Examiner*—Theresa Trieu
(74) *Attorney, Agent, or Firm*—Crowell & Moring LLP

(57) ABSTRACT

To provide a seal configuration which prevents leakage of high pressure compressed fluid from a succeeding stage compression section to a preceding stage compression section of a multistage compression type fluid machine, a seal element 25 is located on the rand 9*a* between the discharge port 2*e* located at the end of the spiral lap groove of the preceding stage compression section and the suction port 2*f* located at the start of the spiral lap groove of the succeeding stage compression section to suck in the compressed fluid discharged from said discharge port and cooled through passing a cooler.

1 Claim, 12 Drawing Sheets

MULTI-STAGE SCROLL FLUID MACHINE HAVING A SET A SEAL ELEMENTS BETWEEN COMPRESSION SECTIONS

CROSS REFERENCE TO RELATED APPLICATIONS

The present application is a division of application Ser. No. 10/729,908, filed Dec. 9, 2003 now U.S. Pat. No. 7,001,161, which in turn is a division of application Ser. No. 10/289,440, filed Nov. 7, 2002, now U.S. Pat. No. 6,682,328, which was a division of application Ser. No. 09/983,017, filed Oct. 22, 2001, now abandoned, the entire disclosures of which are incorporated herein by reference. Priority is claimed based on Japanese Patent Application No. 2000-322025, filed Oct. 20, 2000.

BACKGROUND OF THE INVENTION

1. Field of the Invention

The present invention relates to a scroll fluid machine for compressing or expanding or pressure feeding fluid, specifically to a seal configuration of a scroll fluid machine having multistage compression section in which the fluid compressed in the preceding stage compression section is cooled to be compressed in the succeeding stage compression section and a seal element is provided to prevent the leakage of the compressed fluid from the succeeding stage compression section to the preceding stage compression section.

2. Description of the Related Art

It is general in scroll fluid machines that revolving scrolls and stationary scrolls are cooled with cooling air or cooling fluid to remove the heat generated by the compression of the fluid. To attain a compression ratio larger than usual is possible by increasing the number of turns of the scroll. However, there arise problems by increasing the compression ratio than usual that not only the machine becomes large but the life of the bearings and seal elements are shortened due to the high temperature higher than usual owing to the larger compression ratio.

Therefore it becomes necessary to provide a larger cooling device to obtain a larger amount of cold heat for removing the increased heat due to increase compression ratio from the revolving scroll and stationary scroll. In a scroll fluid machine, the fluid is taken in from the peripheral part of the end plate of the revolving scroll, the compression space into which the fluid is taken in is reduced toward the center to compress the fluid, and the compressed fluid is discharged from the discharge port located in the center part. High level technique is necessary to efficiently cool the center part.

For this reason, a multistage compression type scroll machine was demanded which has two stages of compression sections, the compressed fluid discharged from the preceding stage being passed through the cooler to be introduced to the succeeding stage to be again compressed. The multistage compression type scroll machine can compress fluid to a desired high compression ratio without raising the temperature of the constituent parts of the scroll fluid machine higher than usual by restraining the temperature of the compressed fluid in the preceding stage to the temperature the constituent parts allow, cooling the compressed fluid compressed in the preceding stage compression section, and then again compressing the compressed and cooled fluid if the succeeding stage compression section.

A multistage compression type scroll machine which has two stages of compression sections and in which the compressed fluid from the preceding stage is cooled by passing through a cooler and then introduced to the succeeding stage to be again compressed is disclosed in Japanese Unexamined Patent Publication 54-59608.

The conventional art includes, however, the problem as described below. This will be explained with reference to FIG. 10 to 12. The discharge port 2*e* in the vicinity of the final compression chamber of the preceding stage compression section and the suction port 2*f*, which communicate with the space into which the fluid is taken in, of the succeeding stage compression section are connected with a piping by the medium of a cooler not shown in the drawing, the connection constituting an intermediate passage.

Now, after the compression space S3 of the preceding stage compression section communicates with the discharge port 2*e* of the preceding stage compression section, the compression space S6 and T6 of the succeeding stage compression section become communicated with the compression space S5 of the preceding stage compression section, as shown in FIG. 10. The fluid taken into the compression space S6 is compressed by the rotation of the revolving scroll lap 10*b* to the compression space S8, and the fluid taken into the compression space T6 is compressed to the compression space T8. Therefore, the pressure in the space S8 is higher than that in the space S6, and the pressure in the space T8 is higher than that in the space T6.

As can be seen in FIG. 11(*a*), FIG. 11(*b*), and FIG. 12, which show respectively A—A section, B—B section, and C—C section in FIG. 10, a tip seal 53 is received in the groove 41 formed in the tip of the revolving scroll lap 10*b* and in the groove 40 formed in the tip of the stationary scroll lap 9*c* respectively. As the tip seal 53 is shaped narrower in width than that of the groove 40 and 41, the tip seals 53, 53 receive the pressure of the compressed fluid of each compression space to be pushed against the mirror face each mating scroll and at the same time to be pushed against the wall each groove toward lower pressure side.

Accordingly, the passage 30 and 31 communicating with the compression space T6 are formed as shown in FIG. 11(*a*), and the leakage to the lower pressure space T6 is possible.

The passage 32 and 51 communicating with the compression space S8 are formed as shown in FIG. 11(*b*), and the leakage to the lower pressure space S6 is possible.

The tip seal is pushed against the groove wall toward lower pressure side. However, the side face of the tip seal and the groove face can not be brought to absolute contact with each other because of the imperfect flatness of the faces. Accordingly, the leakage of high pressure fluid in the direction of arrow 76 to the gap 80 between the tip seal 14 and 53 is possible as shown in FIG. 12(*a*) which shows C—C section in FIG. 10.

There is a gap between the bottom of the groove formed in the tip of the revolving scroll lap and the tip seal 53, so the leakage of the fluid is possible from higher pressure side to lower pressure side. This means that, as a gap exists between the end face 41*a* of the groove 41 and the end face 53*a* of the tip seal 53 at the end part 10*d* of the revolving scroll lap 53, the leakage of the compressed fluid in the direction of arrow 78 is possible, and also the leakage as shown by arrow 77 is possible from the passage 51.

Therefore, as shown in FIG. 10 and FIG. 12(*a*), the high pressure fluid leaks from the succeeding stage compression section to the preceding stage compression section through the gap 80 shown by arrow 29 and 76 to be taken into the preceding stage compression section to be compressed again, which causes problems of high temperature and excessive power requirement for compression.

SUMMARY OF THE INVENTION

The present invention was made to solve the problem mentioned above, the object is to provide the seal construction of a multi-stage compression type scroll fluid machine for preventing the leakage of high pressure compressed fluid to the preceding stage compression section from the succeeding stage compression section.

To solve the problem mentioned above, the present invention offers a scroll fluid machine with multistage compression section in which the fluid compressed in the preceding stage compression section is further compressed in the succeeding stage compression section characterized in that:

a lap groove is formed spiraling from the vicinity of the discharge port of the compressed fluid of the final stage compression space to the fluid take-in side of the initial stage compression space, in the tip of the lap being formed a tip seal grove to receive a seal element, and a rand is formed between the discharge port at the compression end part of said preceding stage compression section and the suction port of the succeeding stage compression section; and an intermediate seal element is received in the intermediate groove formed on the surface of said rand which faces the end plate of the mating scroll for preventing the leakage of the compressed fluid from said succeeding stage compression section to said discharge port opening side of said preceding stage compression section.

In the present invention, the scroll lap on the tip of which is located a tip seal which contacts and slide on the mating scroll end plate, is formed spirally from the vicinity of the discharge port of compressed fluid in the final stage compression space toward the take-in side of the initial stage compression section forming lap grooves between said lap and the adjacent lap of the mating scroll; and a rand is formed between the discharge port at the end part of the lap groove of said preceding stage compression section and the suction port at the starting part of the lap groove of said succeeding stage compression section. The compressed fluid discharged from said discharge port is introduced in said succeeding stage compression section from said suction port via an intermediate passage provided with a cooler.

Said rand may be formed in the stationary scroll or in the revolving scroll.

In the tip groove of the lap is received a tip seal which is pushed by fluid pressure against the mirror surface of the mating scroll end plate, so a gap is produced between said mirror face of the mating scroll end plate and the surface of said rand, and said discharge port opening is communicated through said gap with said suction port opening. Therefore, the compressed fluid leaked from space S6, T6, and T8 as shown by arrow 29 and 76 toward said suction port opening of the succeeding stage compression section (the leak passage is explained in FIG. 11, 12) advances toward said discharge port opening of the preceding stage compression section. But, according to the present invention, an intermediate seal element is provided on the rand between said suction port opening and said discharge opening, so the leakage of the compressed fluid toward the discharge port opening side is prevented.

The seal element consists of a tip seal received in the tip groove formed in the spiral lap and an intermediate seal element received in the grove formed in the rand between the discharge port opening and the suction port opening.

As shown in FIG. 2 for example, the seal element 26 (tip seal) seals to partition the lap groove in the succeeding stage compression section, a seal element 14 (tip seal) seals to partition the lap groove in the preceding stage compression section, and an intermediate seal element 25 seals the gap between the rand and the mating scroll end plate. The seal element 26 is the extension of the seal element 14.

It is suitable to form the intermediate seal element as circular seal element partitioning the succeeding stage compression section circularly.

In this case, as shown in FIG. 6 for example, the intermediate seal element is formed as a closed, single circular seal, part of which contributes as the intermediate seal on the rand between the suction and discharge port opening. As the seal element surrounds completely the succeeding stage compression section as a single seal element, effective seal between the succeeding stage compression section and the preceding stage compression section is performed.

It is also suitable that the seal element consists of a first seal element which extends spirally from the fluid take-in side of said preceding stage compression section side to the final discharge port side of said succeeding stage compression section and partitions said discharge port opening and said suction port opening at said rand surface in the course of its extension; and a second seal element, an end of which contacts the side face of said first seal element at the side opposite to said discharge port opening in the vicinity of said discharge port opening and which extends from the vicinity of said discharge port opening to the vicinity of said discharge port opening, surrounding said succeeding stage compression section to contact the side face of said first seal element at the side opposite to said suction port opening.

It is also suitable that a tip seal groove is formed extending spirally from the fluid take-in side of said initial stage compression section toward the compressed fluid discharge port side of said final stage compression space, an intermediate groove is formed communicating with said tip seal groove in said rand between said discharge port opening and said suction port opening, a set of seal elements consisting of a plurality of seal elements is received in said intermediate groove and said tip seal groove, said seal set consists of;

a first tip seal which extends from the compressed fluid discharge port side of said final stage compression space toward said initial stage compression space via said intermediate groove, a second tip seal which extends parallel with said first tip seal from the compressed fluid discharge port side of said final stage compression space to the vicinity of said suction port opening where the second tip seal depart from said first tip seal and contacts said first seal in the vicinity of said discharge port opening, and a third tip seal which extends in said tip groove parallel with said second tip seal from the vicinity of said suction port opening to partition said succeeding stage compression section circularly and further extends parallel with said first tip seal toward said initial stage compression section side.

With this configuration, as shown in FIG. 8 for example, the third tip seal 68 is located in the outer side of the second tip seal 69 which contacts the side face of the first tip seal 67 in the vicinity of the discharge port opening, so the contact portion of the first tip seal 67 and the second tip seal 69 is covered by the third tip seal. Thus, the sealing between the preceding stage compression section and the succeeding stage compression section is performed by the first seal element and the second seal element completely like the case shown in FIG. 6, and the leakage of the compressed fluid to the preceding stage compression section is effectively prevented.

It is also suitable that a tip seal groove is formed extending spirally from the fluid take-in side of said initial stage compression section toward the compressed fluid discharge port side of said final stage compression space, an intermediate groove is formed communicating with said tip seal groove in said rand between said discharge port opening and said suction port opening, and said seal element is a single tip seal received in said tip seal groove and said intermediate groove.

With this configuration of the seal element, the prevention of leakage of the compressed fluid is performed by a single tip seal, and the number of constituent parts is reduced.

In addition, as the tip seal can be inserted into the groove taking the part of the tip seal corresponding to the intermediate groove as the position basis, it is easier to assemble the tip seal into the tip groove. First the intermediate part of the seal element is inserted into the intermediate groove, then the remaining part can be easily inserted along the tip groove toward the center side in one hand and toward the outer periphery side on the other hand.

Figure 1:
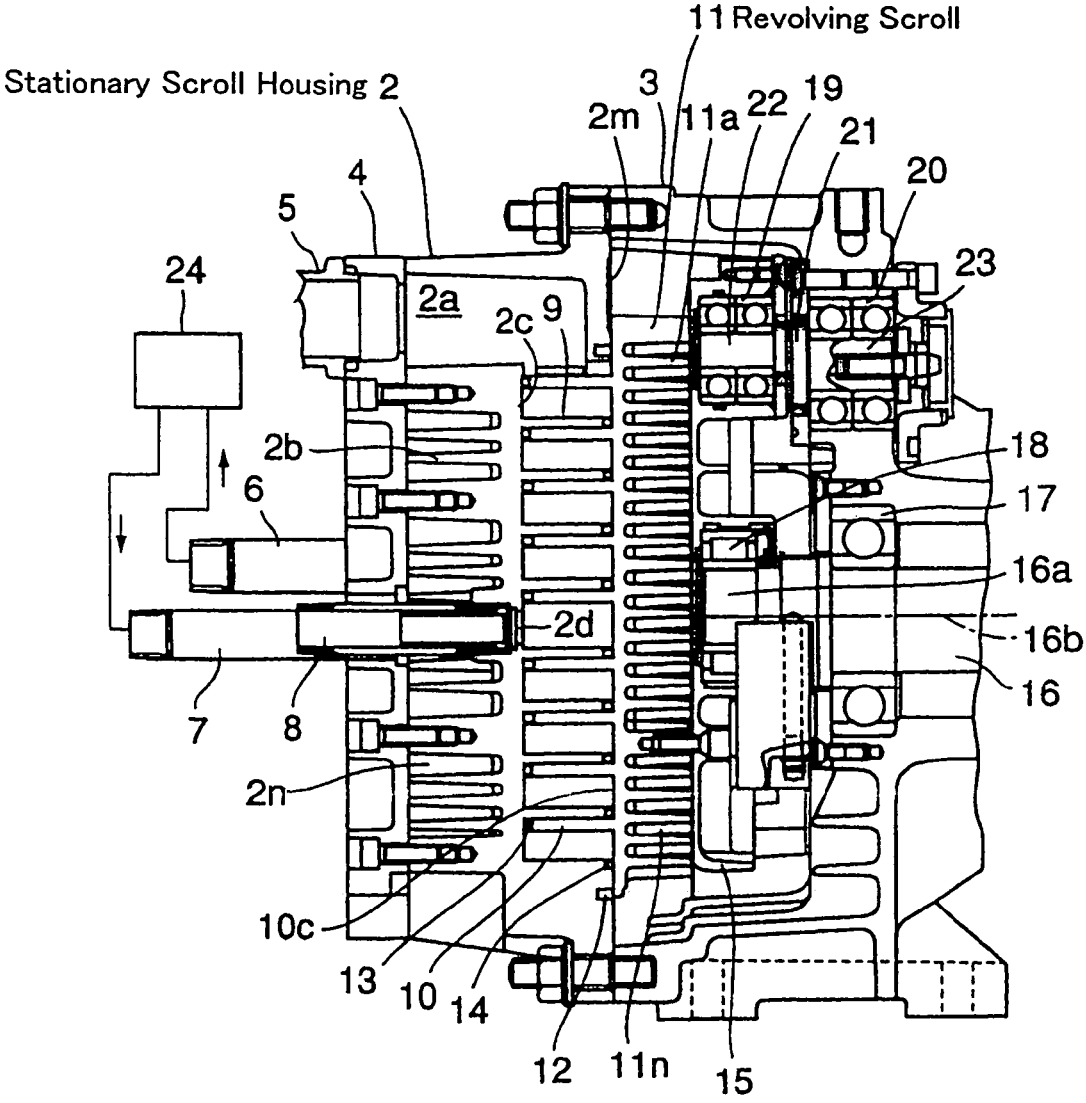
FIG. 1 is a cross-sectional view of the scroll fluid machine of an embodiment according to the present invention.

Reference numeral 1 denotes scroll fluid machine, 2 denotes stationary scroll housing, 2*e* denotes discharge port, 2*f* denotes suction port, 3 denotes driveshaft housing, 9*a* denotes rand, 11 denotes revolving scroll, 24 denotes cooling room, 25 denotes intermediate seal element(seal element), 27 and 28 denote spiral grooves formed by stationary scroll laps.

DETAILED DESCRIPTION OF PREFERRED EMBODIMENTS

A preferred embodiment of the present invention will now be detailed with reference to the accompanying drawings. It is intended, however, that unless particularly specified, dimensions, materials, relative positions and so forth of the constituent parts in the embodiments shall be interpreted as illustrative only not as limitative of the scope of the present invention.

Figure 2:
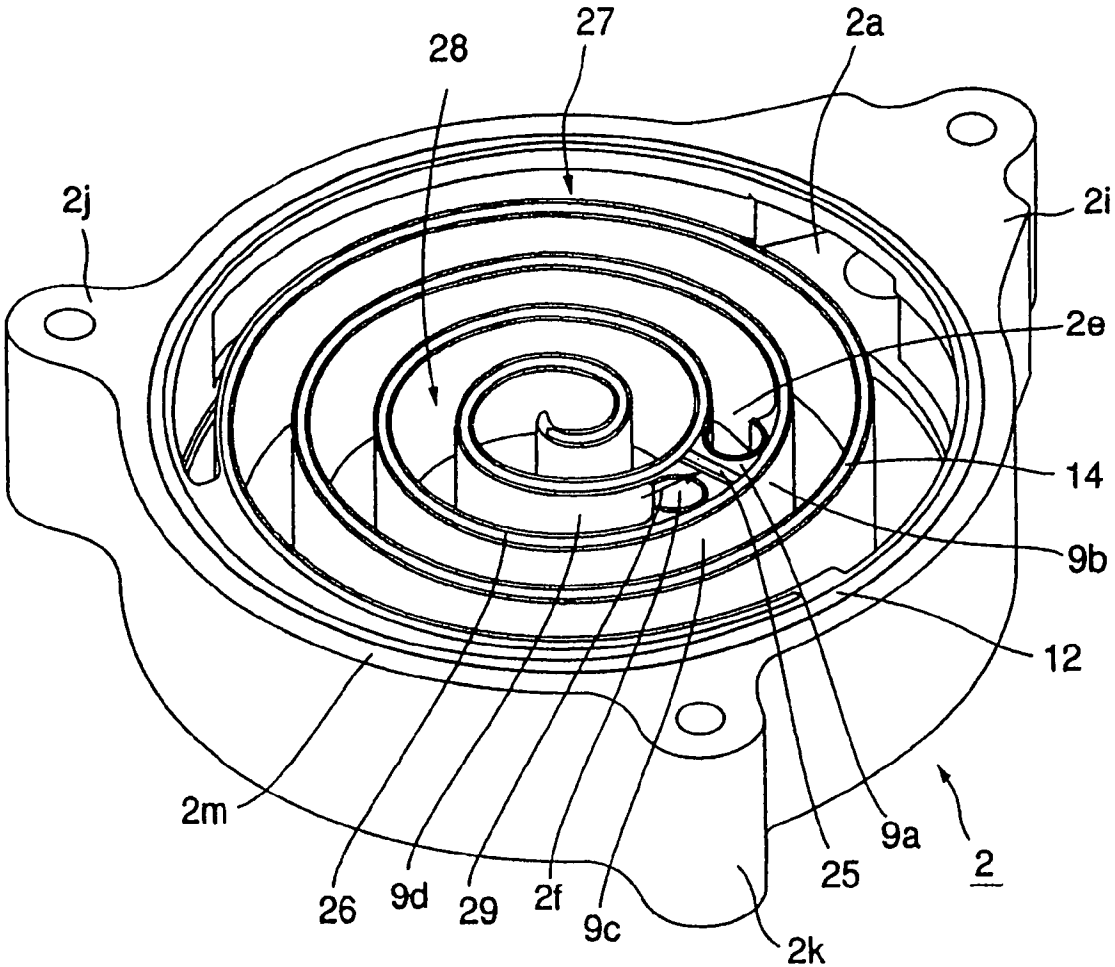
FIG. 2 is a perspective view of the scroll housing.
Figure 3:
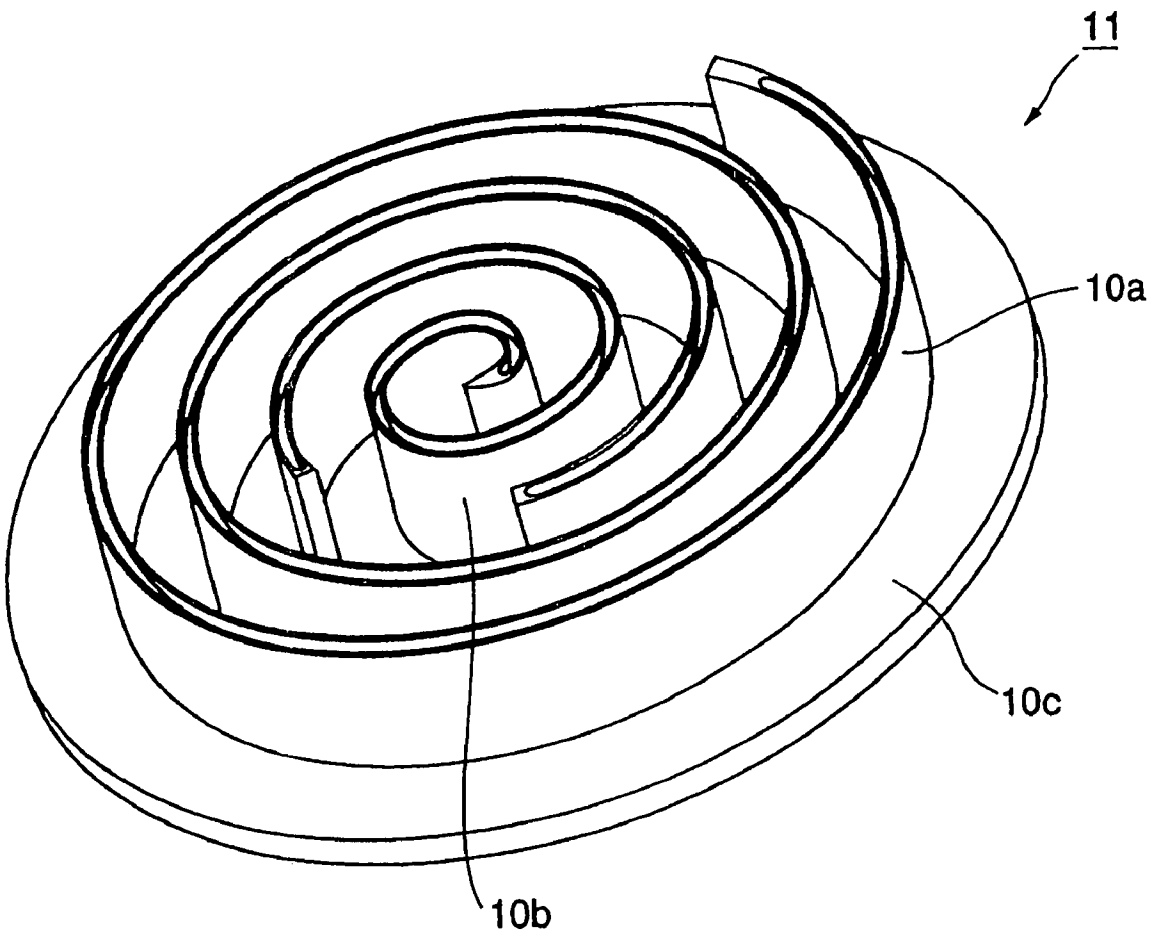
FIG. 3 is a perspective view of the revolving scroll.
Figure 4:
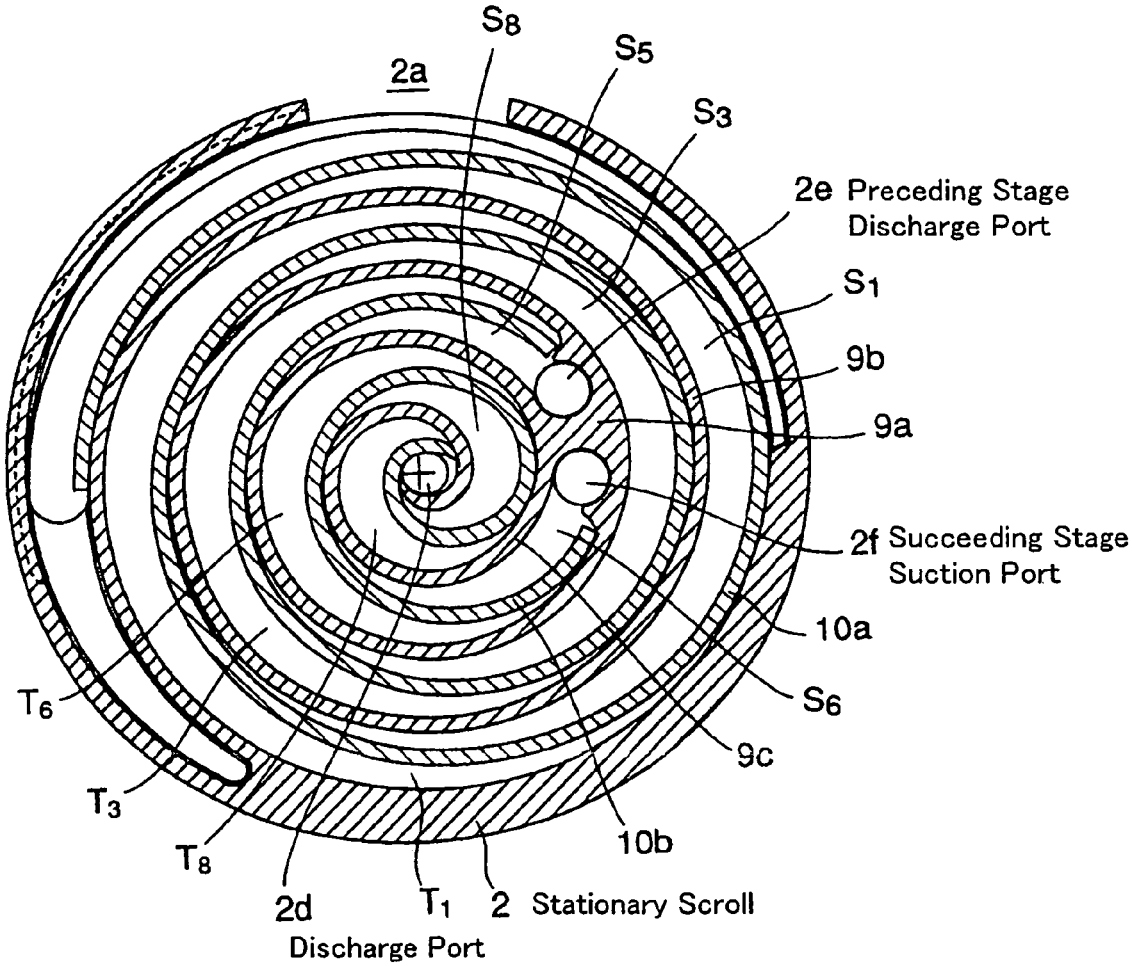
FIG. 4 is an elevational view in section of the stationary scroll for explaining the condition of compression of the fluid when the fluid is taken in by the revolving scroll lap.
Figure 5:
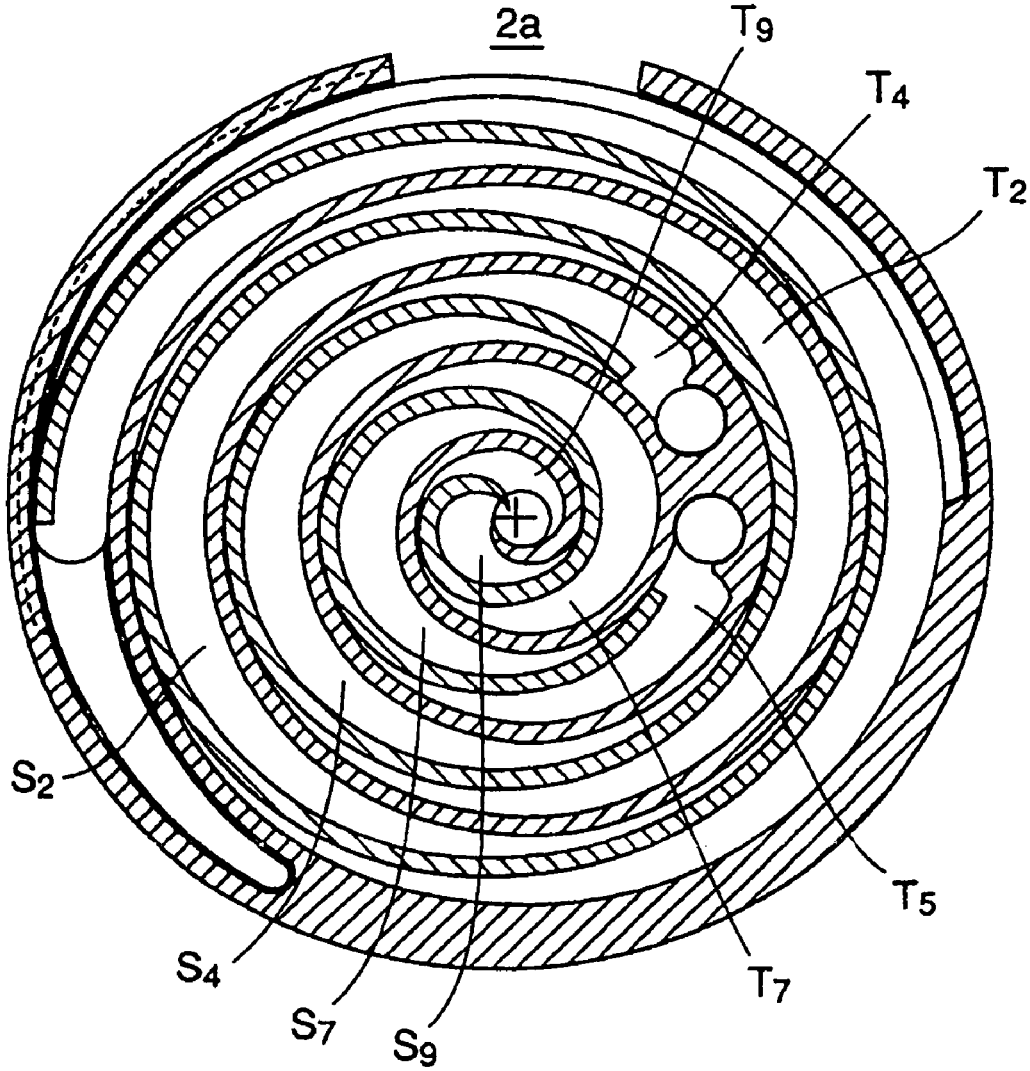
FIG. 5 is an elevational view in section of the stationary scroll for explaining the condition of compression of the fluid when the revolving scroll is rotated by 180° from situation in FIG. 4.
Figure 6:
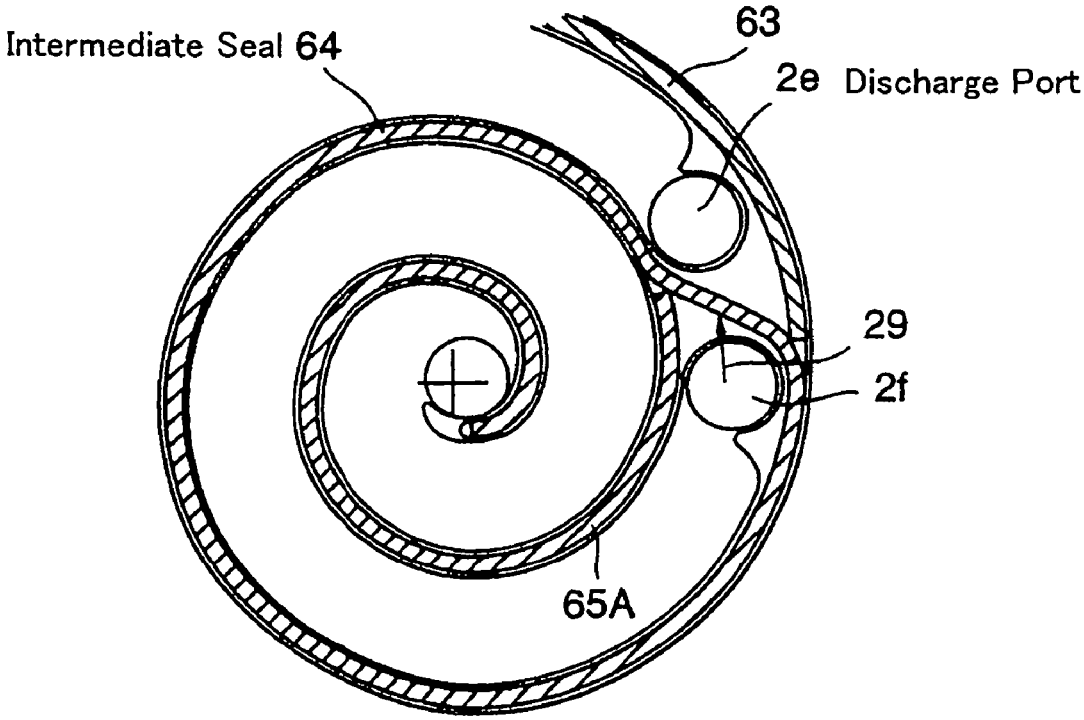
FIG. 6 is an explanatory representation of the second embodiment of seal construction according to the present invention.
Figure 7:
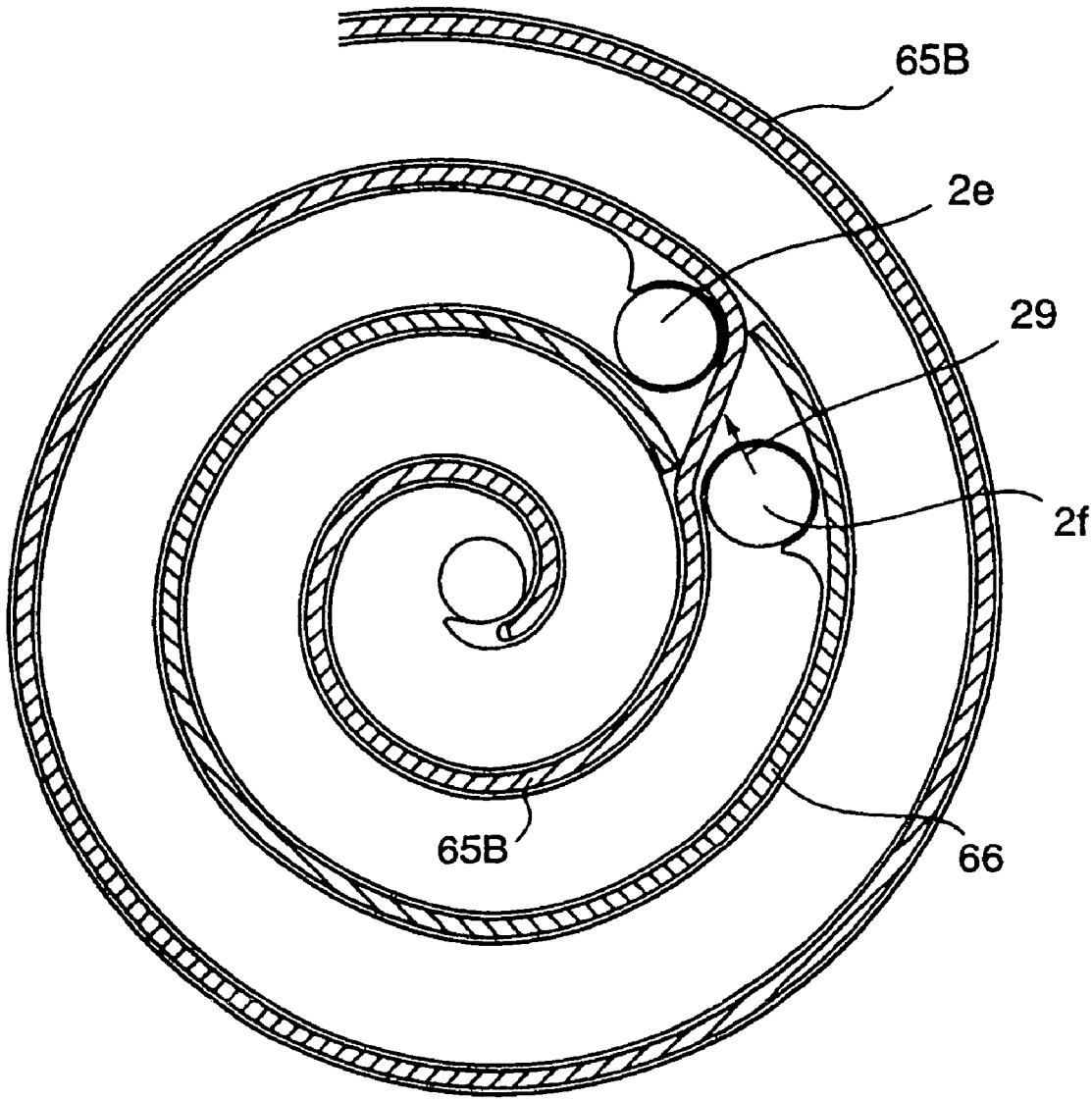
FIG. 7 is an explanatory representation of the third embodiment of seal construction according to the present invention.
Figure 8:
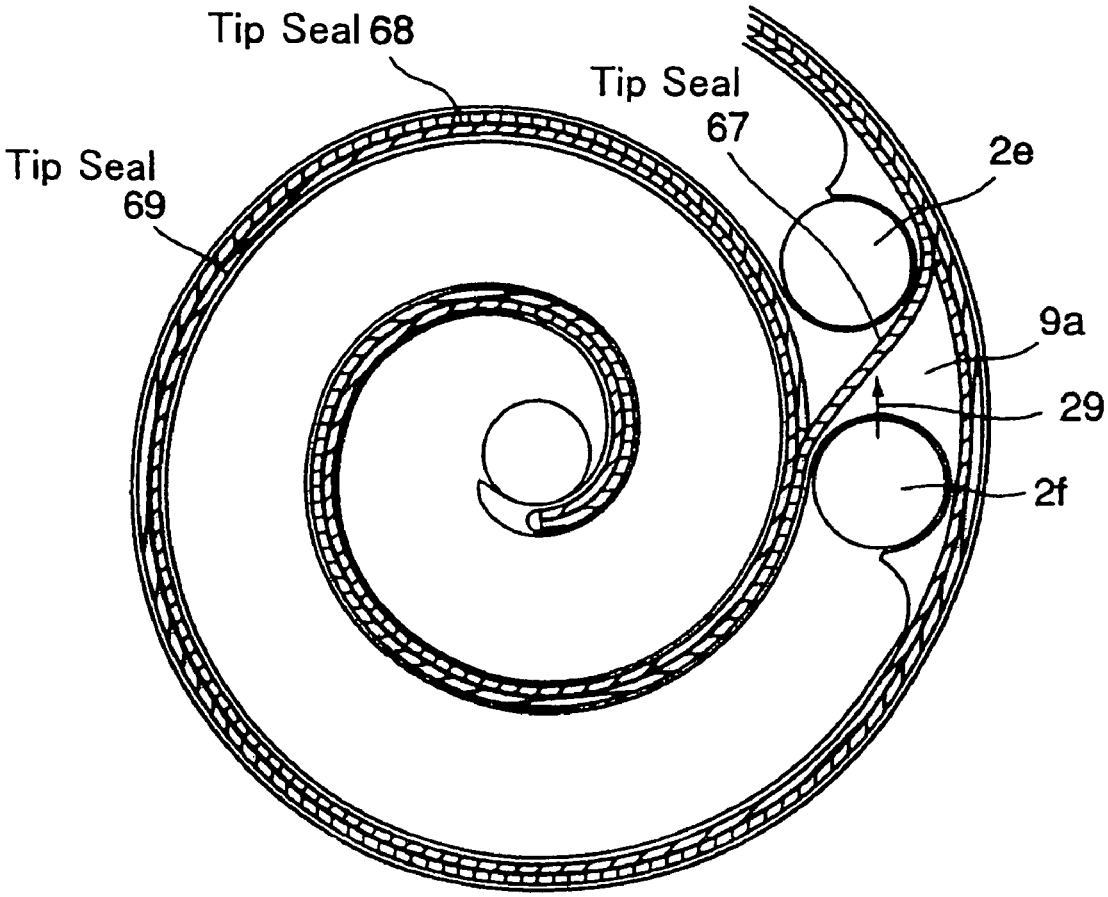
FIG. 8 is an explanatory representation of the fourth embodiment of seal construction according to the present invention.
Figure 9:
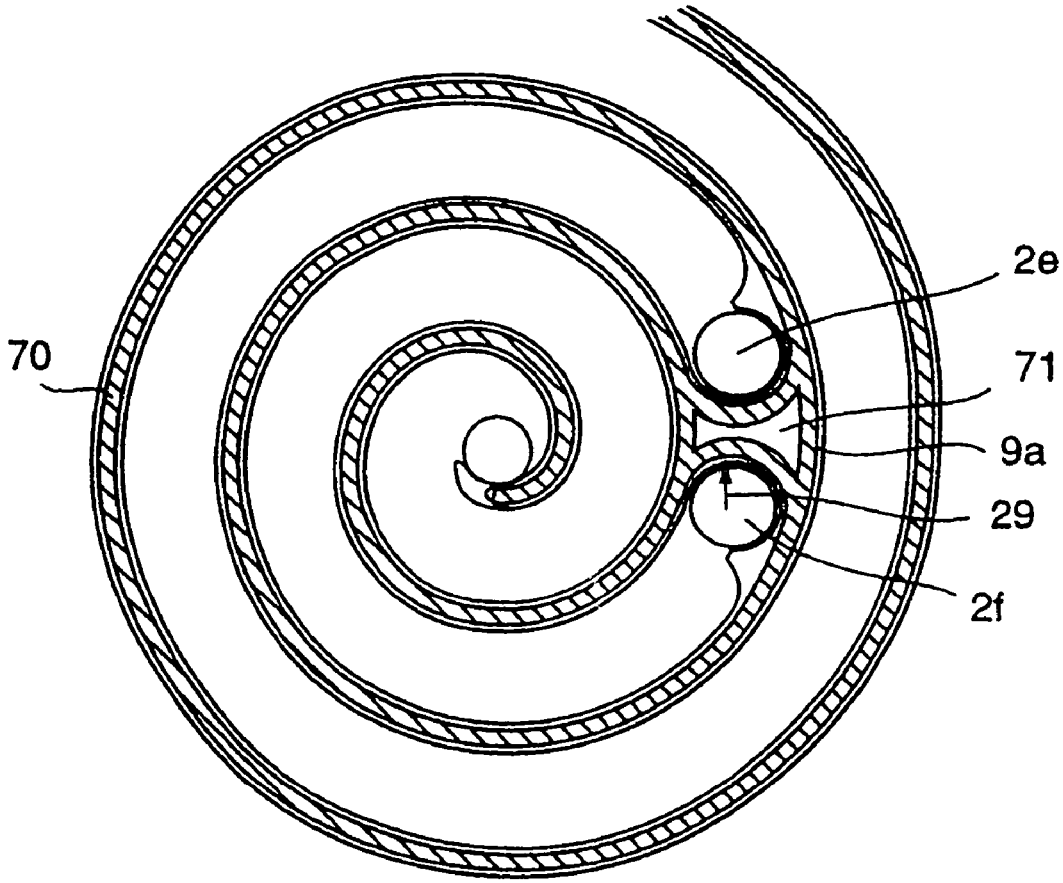
FIG. 9 is an explanatory representation of the fifth embodiment of seal construction according to the present invention.
Figure 10:
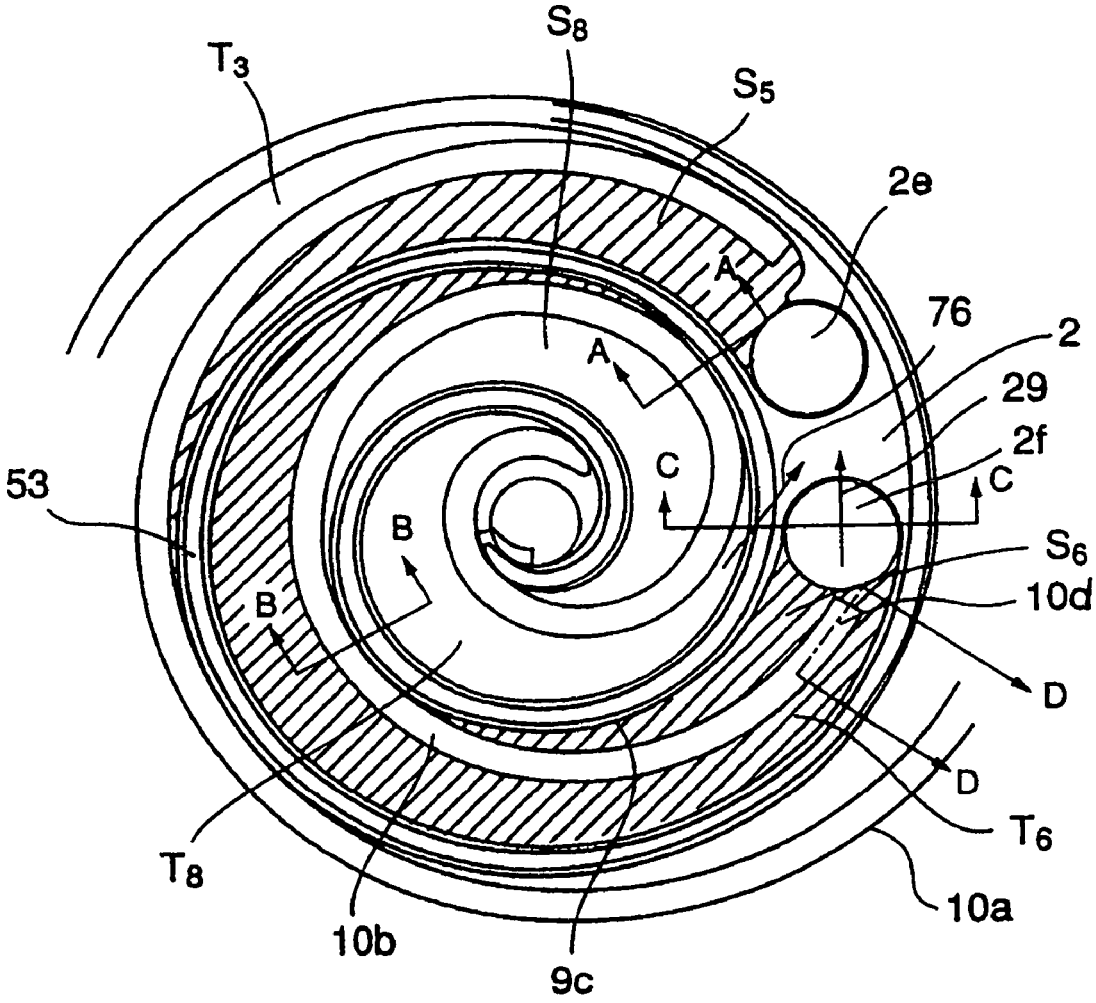
FIG. 10 PRIOR ART
FIG. 10 is a plan view of scroll for explaining taking-in action of compressed fluid into the succeeding stage compression section of the conventional art.
Figure 11A:
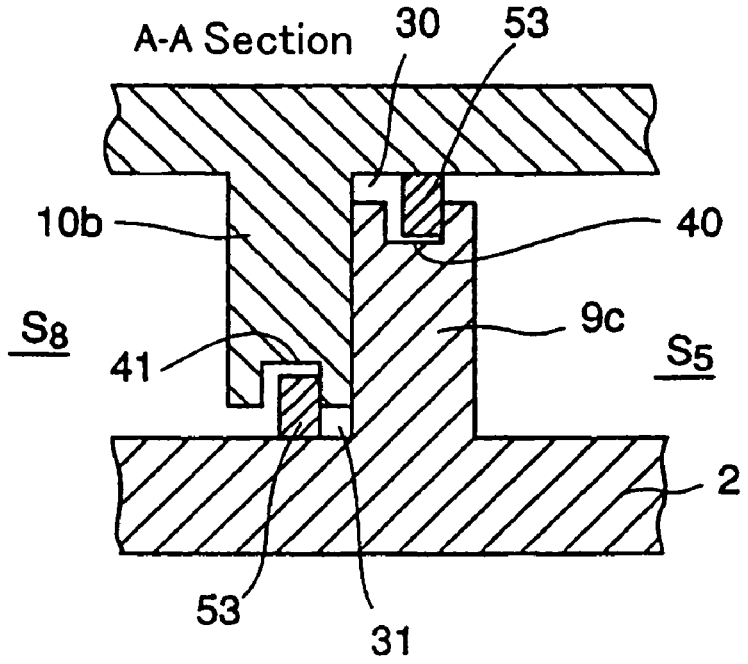
FIG.11(a) PRIOR ART
FIGS. 11(*a*) and (*b*) is a partial sectional view along line A—A and B—B respectively in FIG. 10.
Figure 11B:
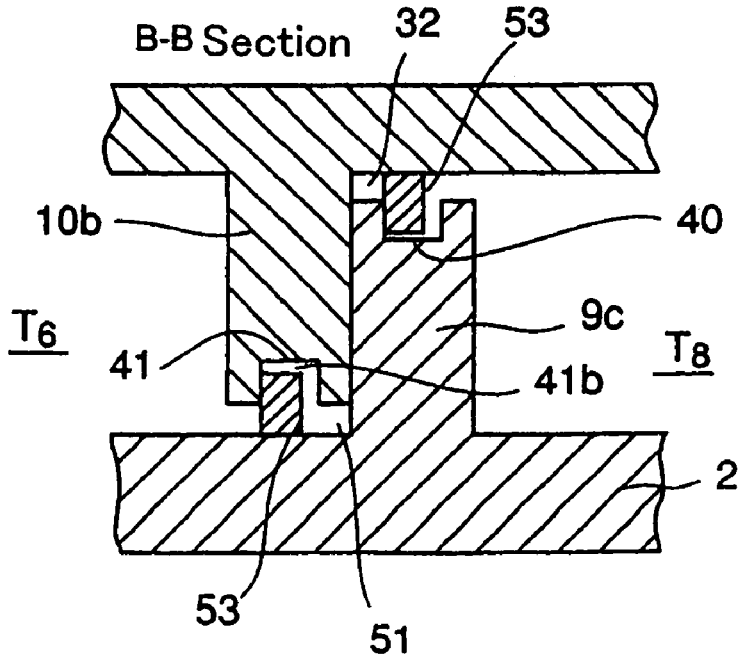
FIG.11(b) PRIOR ART
Figure 12A:
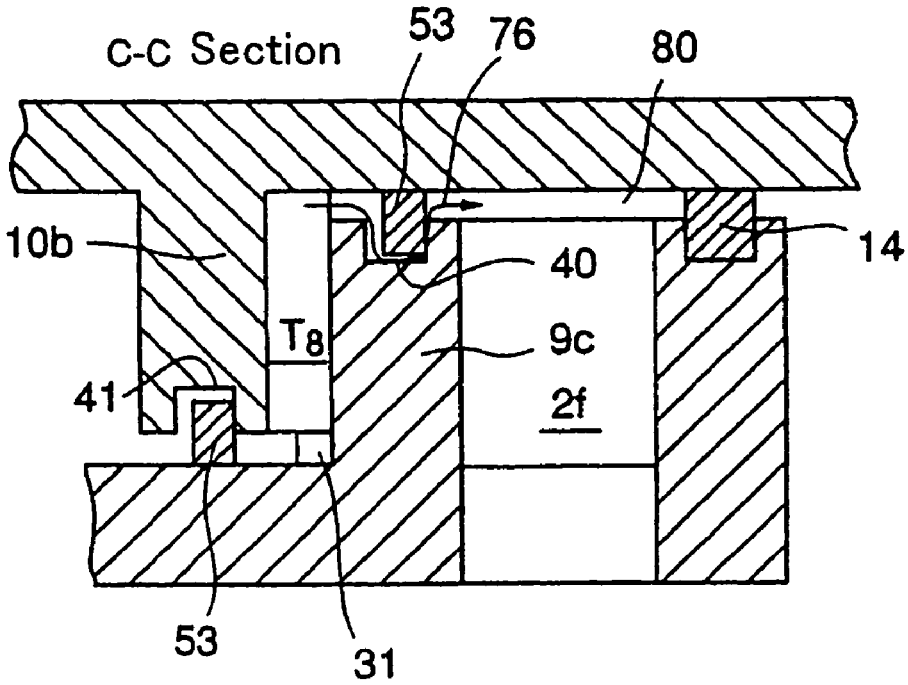
FIG.12(a) PRIOR ART
FIGS. 12(*a*) and (*b*) is a partial sectional view along line C—C and D—D respectively in FIG. 10.
Figure 12B:
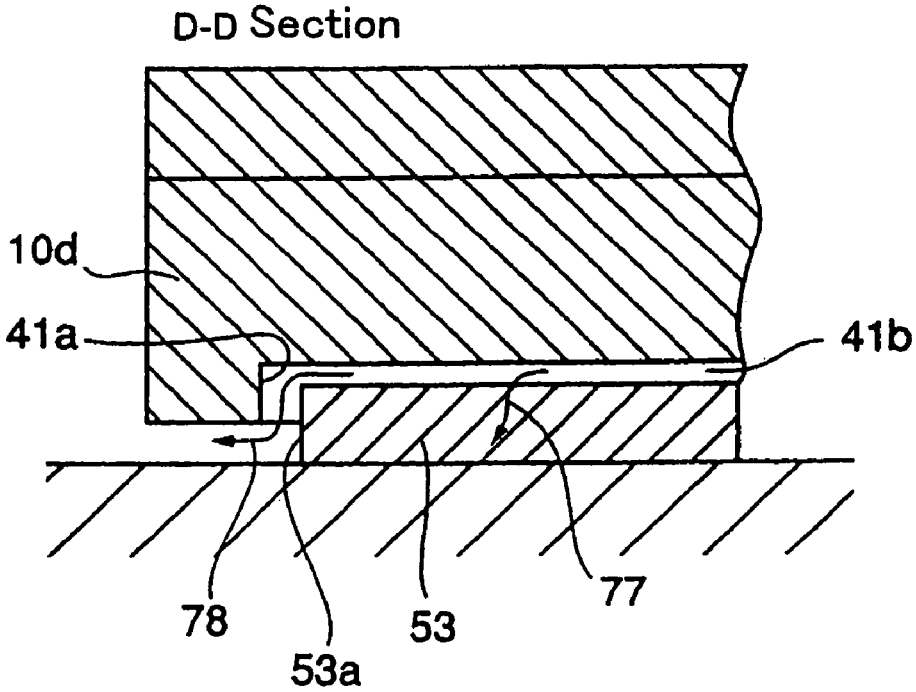
FIG.12(b) PRIOR ART

FIG. 1 is a cross-sectional view of the scroll fluid machine of an embodiment according to the present invention, FIG. 2 is a perspective view of the scroll housing, FIG. 3 is a perspective view of the revolving scroll, FIG. 4 is an elevational view in section of the stationary scroll for explaining the condition of compression of the fluid when the fluid is taken in by the revolving scroll lap, FIG. 5 is an elevational view in section of the stationary scroll for explaining the condition of compression of the fluid when the revolving scroll is rotated by 180° from the situation in FIG. 4, FIG. 6 is an explanatory representation of the second embodiment of seal construction according to the present invention, FIG. 7 is an explanatory representation of the third embodiment of seal construction according to the present invention, FIG. 8 is an explanatory representation of the fourth embodiment of seal construction according to the present invention, FIG. 9 is an explanatory representation of the fifth embodiment of seal construction according to the present invention.

In FIG. 1, the multistage type scroll fluid machine body 1 is composed of a stationary scroll housing 2 with a housing cover 4 attached to it and a driveshaft housing 3 to which the stationary scroll housing 2 is attached.

A cooling room 24 is provided between a discharge pipe 6 connected to the discharge port of the preceding stage compression section mentioned later of the stationary scroll housing and the suction pipe 7 connected to the suction port of the succeeding stage compression section. The cooling room 24, discharge pipe 6, and suction pipe 7 connected by piping constitute an intermediate passage.

The volume of the intermediate passage from the discharge port 2*e* of the preceding stage through the piping passing in the cooling room to the suction port 2*f* of the succeeding stage is determined to be N (integer) times the final compression chamber volume of the preceding stage compression section. Thus, after N times of discharge from the final compression chamber of the preceding stage compression section, the same volume of fluid as that of the final compression chamber of the preceding stage compression section is taken into the succeeding stage compression section.

However, when the scroll fluid machine is at a standstill at the start of initial operation, fluid exists in the final compression chamber of the succeeding stage compression section of the fluid compression space formed by the stationary scroll lap and revolving scroll lap at the pressure equal to the outside pressure at the discharge port 2*d* (see FIG. 1) or lower.

The pressure of the fluid in the initial intake space of the succeeding stage compression section, as the intake space communicates with the intermediate passage, may be reduced to the intake pressure of the preceding stage compression section.

When the initial operation is started in this state, the fluid residing in the succeeding stage compression section is compressed to a pressure higher than the outside pressure.

That is, if the pressure when the fluid in the final compression chamber of the succeeding compression chamber is connected with the fluid in the compression chamber existing toward the suction port side of the succeeding compression chamber is higher than the outside pressure, the fluid is discharged to the outside, but if the pressure is still lower than the outside pressure, fluid is taken in from the intermediate passage and the fluid is discharged together with the fluid in the discharge port side.

The initial operation comes to end when, after N times of discharge from the final compression chamber of the preceding stage compression section, the same volume of fluid as that of the final compression chamber of the preceding stage compression section is taken-in into the initial chamber of the succeeding stage compression section.

The stationary scroll housing 2 is formed into a shape of circular tray as shown in FIG. 2. Three ears 2*i*, 2*j*, 2*k* are formed on the periphery of the housing 2 for connecting the driveshaft housing 3 fitting to the mating surface 2*m* of the housing 2 with bolts. The bottom of concave of the housing 2 is finished to a mirror surface 2*c* which communicates with the suction port 2*a* formed in the ear 2*i*.

A circular groove is formed on the mating surface 2*m* and a dust seal 12 made of material having self lubricating property such as fluororesin and the like is received in the groove.

On the mirror surface 2*c* are provided a discharge port 2*e* of preceding stage (see FIG. 4, 5) which communicates with the discharge pipe 6 shown in FIG. 1, and a suction port 2*f* of the succeeding stage (see FIG. 4, 5) which communicates with the suction pipe 7. A stationary scroll lap 9*b* extends spirally in a counterclockwise direction from the rand 9*a* between these ports to form the preceding stage compression section and a stationary scroll lap 9*c* extends spirally in a clockwise direction from the rand 9*a* to form the succeeding stage compression section, embedded on the mirror surface 2*c*. A groove is formed in the tip of each lap, and a tip seal 14 made of material having self lubricating property such as fluororesin and the like is received in each groove.

An intermediate seal element 25 made of material having self lubricating property such as fluororesin and the like is provided on the rand 9*a* between the tip seal 14, 14. The intermediate seal element 25 is to prevent the high pressure compressed fluid from being leaked to the preceding stage compression section side and compressed and again fed back to the succeeding stage compression section.

Cooling fins 2*b* are formed on the rear side of the mirror face 2*c* of the stationary scroll housing 2 as shown in FIG. 1. On the tip of the cooling fins 2*b* is attached the housing cover 4 to form cooling passages 2*n*. Therefore, the stationary scroll is cooled by the cooling air flowing in the direction penetrating the sheet.

A revolving scroll 11 has a mirror face 10*c* on which a revolving scroll lap 10*a* for forming the preceding stage compression section in the outer side region and a revolving scroll lap 10*b* for forming the succeeding stage compression section in the center side region are embedded. The revolving scroll 11 is disposed so that the mirror face 10*c* contacts the dust seal 12 provided on the mating face of the stationary scroll housing 2. A groove is formed in the tip of each lap and a tip seal 13 made of material having self lubricating property such as fluororesin and the like is received in each groove.

The revolving scroll 11 is disposed so that the walls of the revolving scroll lap 10*a*, 10*b* face the walls of the stationary scroll lap 9*b*, 9*c* respectively.

Cooling fins 11*a* are formed on the rear side of the mirror face as shown in FIG. 1. On the tip of the cooling fins is attached an auxiliary cover 15 to form cooling passages 11*n*. Therefore, the revolving scroll is cooled by the cooling air flowing in the direction penetrating the sheet.

A bearing 18 which supports for rotation the eccentric 16*a* formed at the end of a rotation driveshaft 16 mentioned later is located in the center of the auxiliary cover 15, and in the periphery side thereof are located bearings 19 at the positions equally divided in three along a circumference to support crank assemblies to prevent the rotation of the revolving scroll.

Each crank assembly is composed of a plate 21 having on the one side a shaft 22 supported by the bearing 19 and on the other side a shaft 23 offset in relation to the shaft 22.

The shaft 23 is supported by a bearing 20 located in the driveshaft housing 3. The eccentric 16*a* revolves around the center axis of the rotation driveshaft 16 as the shaft 16 rotates, and the revolving scroll 11 performs revolving motion in relation to the stationary scroll.

The driveshaft housing 3 has an opening on its side to introduce cooling air in the direction penetrating the sheet on which FIG. 1 is depicted for cooling the cooling fins 11*a* of the revolving scroll. The rotation drive shaft 16 is supported by a bearing 17 for rotation in the center of the driveshaft housing 3 and connected with the rotation shaft of a motor not shown in the drawing.

With the construction mentioned above, the revolving scroll revolves as the rotation shaft 16 rotates, and as shown in FIG. 4, the fluid sucked from the suction port 2*a* of the stationary scroll housing 2 is taken in by the revolving scroll lap 10*a* to be trapped in the enclosed space S1 and T1 formed by the revolving scroll lap 10*a* and stationary scroll lap 9*b*.

These two enclosed spaces differ in phase by 180°, but the volume is about the same.

The enclosed spaces move as the revolving scroll revolves as shown in FIGS. 4 and 5. The fluid taken-in in the enclosed space S1 in FIG. 4 is compressed sequentially from S1 to S2→S3→S4→S5, from S5 to the preceding stage discharge port 2*e*→intermediate passage→succeeding stage suction port 2*f*→S6→S7→S8→S9, the fluid taken-in in the enclosed space T1 in FIG. 4 is compressed sequentially from T1 to T2→T3→T4, from T4 to the preceding stage discharge port 2*e*→intermediate passage→succeeding stage suction port 2*f*→T5→T6→T7→T8→T9, and the compressed fluid in the spaces S9 and T9 are discharged together from the discharge port 2*d* in the center to a pipe 8 to be sent out.

Since the volume of the final compression space of S side and T side is the same, the fluid of the same pressure is discharged from S side final compression space and T side final compression space through the discharge port 2*d*.

As the intermediate seal element 25 made of material having self lubricating property such as fluororesin and the like is located between the tip seal 14 and 14 as shown in FIG. 2, the high pressure compressed fluid is prevented by the intermediate seal element 25 from being leaked to the preceding stage compression section side and compressed and again fed back to the succeeding stage compression section.

FIG. 6 shows the second embodiment of seal construction. Instead of the tip seal 14 in the first embodiment, tip seals consisting of a tip seal 63 of the preceding stage compression section, a tip seal 65A of the succeeding stage compression section, and an intermediate seal 64 are used.

The intermediate seal 64 partitions the preceding stage discharge port 2*e* and the succeeding stage suction port 2*f* and encircles the succeeding stage compression section. So, the leakage of high pressure fluid to the preceding stage compression section as shown by arrow 29 in FIG. 6 is prevented.

FIG. 7 shows the third embodiment of seal construction. In the embodiment, tip seals consisting a tip seal 65B extending from the preceding stage compression section to the succeeding stage compression section and a tip seal 66 encircling the succeeding stage compression section are used. The ship seal 65B partitions the preceding stage discharge port 2*e* and the succeeding stage suction port 2*f*. So, the leakage of high pressure fluid to the preceding stage compression section as shown by arrow 29 in FIG. 7 is prevented.

FIG. 8 shows the fourth embodiment of seal construction. In the embodiment, three tip seals 67, 68, and 69 are used. The tip seal 67 extends from the preceding stage compression section to the succeeding stage compression section. The tip seal 69 is located together with the tip seal 67 from the succeeding stage discharge port 2*e* to the succeeding stage suction port 2*f*, then surrounds the outer side of the succeeding stage compression section together with the tip seal 68 until the preceding stage discharge port 2*e*. The tip seal 68 surrounds the outer side of the succeeding stage compression section together with the tip seal 69 until the preceding stage discharge port 2*e*, then is located together with the tip seal 67. So, the leakage of high pressure fluid to the preceding stage compression section as shown by arrow 29 in FIG. 8 is prevented.

FIG. 9 shows the fifth embodiment of seal construction. In the embodiment, a single tip seal 70 is received in the groove formed in the tip of the lap. A vacant space 71 is formed in the rand 9*a*, and the cross-sectional area of the tip seal 70 is about same all along the seal to prevent distortion. As the tip seal 70 is formed as a single seal element, the leakage of high pressure fluid to the preceding stage compression section as shown by arrow 29 in FIG. 9 is effectively prevented.

According to the embodiments described above, a seal element which contacts the face of the end plate of a mating scroll with contact pressure is located on the surface of the rand between the preceding stage discharge port and the succeeding stage suction port, and the leakage of high pressure fluid to the discharge port side of the preceding stage compression section is prevented.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations falling within the scope of the appended claims and equivalents thereof.

What is claimed is:

1. A scroll fluid machine comprising:

a multi-stage compression section in which the fluid compressed in a preceding stage compression section is further compressed in a succeeding stage compression section;

a lap groove formed by spiral laps of both a stationary scroll and a revolving scroll, said laps spiraling from the vicinity of the discharge port for the compressed fluid of a final stage compression space to the fluid intake side of an initial stage compression space, with a tip seal groove formed in the tip of the stationary scroll lap to receive a seal element, and a rand formed between the discharge port at the compression end part of the preceding stage compression section and the suction port of the succeeding stage compression section;

an intermediate seal element received in an intermediate groove formed on the surface of the rand which faces the end plate of the mating scroll for preventing leakage compressed fluid from the succeeding stage compression section to the discharge port opening side of the preceding stage compression section; wherein the tip seal groove is formed extending spirally from the fluid intake side of the initial stage compression section toward the compressed fluid discharge port side of the final stage compression space;

the intermediate groove is formed communicating with the tip seal groove in the rand between the discharge port opening and the suction port opening;

a set of seal elements including a plurality of seal elements is received in said intermediate groove and said tip seal groove, and said seal set including:

a first tip seal which extends from the compressed fluid discharge port side of the final stage compression space toward the initial stage compression space via the intermediate groove, a second tip seal which extends parallel with the first tip seal from the compressed fluid discharge port side of said final stage compression space to the vicinity of said suction port opening where the second tip seal departs from the first tip seal and contacts the first seal in the vicinity of said discharge port opening, and a third tip seal which extends in the tip groove parallel with the second tip seal from the vicinity of the suction port opening to partition the succeeding stage compression section circularly and further extends parallel with the first tip seal toward the initial stage compression section side.

* * * * *